US005746477A

United States Patent [19]

Saul

[11] Patent Number: 5,746,477

[45] Date of Patent: May 5, 1998

[54] UPHOLSTERY TO FURNITURE FASTENER SYSTEM

[75] Inventor: Greg Saul, Charlotte, N.C.

[73] Assignee: O'Sullivan Industries, Inc., Lamar, Mo.

[21] Appl. No.: 794,315

[22] Filed: Feb. 3, 1997

[51] Int. Cl.[6] ..... A47C 31/02

[52] U.S. Cl. ..... 297/218.5; 297/DIG. 6; 297/228.13; 297/452.59

[58] Field of Search ..... 297/218.3, 218.2, 297/218.5, 228.13, 452.59, DIG. 6, 219.1

[56] References Cited

U.S. PATENT DOCUMENTS

| | | | |
|---|---|---|---|
| 3,025,104 | 3/1962 | Murphy . | |
| 3,174,797 | 3/1965 | Neufeld . | |
| 3,610,719 | 10/1971 | Alston . | |
| 4,019,776 | 4/1977 | Takamatsu . | |
| 4,271,566 | 6/1981 | Perina | 297/DIG. 6 |
| 4,408,797 | 10/1983 | Franck et al. . | |
| 4,786,123 | 11/1988 | Rock et al. . | |
| 4,883,331 | 11/1989 | Mengel . | |
| 5,015,034 | 5/1991 | Kindig et al. | 297/218.5 |
| 5,023,125 | 6/1991 | Gray . | |
| 5,067,772 | 11/1991 | Koa | 297/DIG. 6 |
| 5,088,747 | 2/1992 | Morrison et al. . | |
| 5,090,787 | 2/1992 | Harley . | |
| 5,263,764 | 11/1993 | Laughlin et al. . | |
| 5,457,867 | 10/1995 | Maberry et al. . | |
| 5,503,454 | 4/1996 | Sakamoto | 297/218.5 |
| 5,540,480 | 7/1996 | Christa . | |
| 5,560,677 | 10/1996 | Cykana et al. | 297/218.3 |

FOREIGN PATENT DOCUMENTS

| | | |
|---|---|---|
| 2671000 | 7/1992 | France . |
| 2251238 | 5/1974 | Germany . |
| 2358166 | 5/1975 | Germany . |
| 3038832 | 5/1982 | Germany . |
| 1600137 | 10/1981 | United Kingdom . |

*Primary Examiner*—Milton Nelson, Jr.
*Assistant Examiner*—Anthony D. Barfield
*Attorney, Agent, or Firm*—Haynes and Boone L.L.P.

[57] ABSTRACT

A system and method for attaching upholstery to an article of furniture. The article of furniture includes a shell, such as a seat shell or a back shell, having an inner and outer surface. A molded lip extends longitudinally around the outer perimeter of the shell and a tongue extends laterally from the inner surface of the shell, just inside the molded lip. A first fastener strip, such as a hook fastener, is applied to the tongue so that it is facing the outer perimeter of the shell. A second fastener strip, such as a loop fastener, is attached to an outer hem of the upholstery. As a result, the first and second fastener strips can engage, thereby attaching the upholstery to the article of furniture. In addition, a cushion may be secured between the shell and the upholstery when the first and second fastener strips are engaged.

6 Claims, 2 Drawing Sheets

30
34
10
26
18
54
48
50
52
16
20a
24
32
28
40
14
12

UPHOLSTERY TO FURNITURE FASTENER SYSTEM

BACKGROUND OF THE INVENTION

The invention relates generally to furniture and upholstery and, more particularly, to system and method for attaching upholstery to an article of furniture.

It is often desired to remove or replace an upholstery cover from an article of furniture for various reasons, such as to clean the upholstery or to exchange the upholstery for one of a different color or fabric. However, such removal or replacement is typically difficult, requiring several tools such as a staple remover or a staple gun. Furthermore, after replacement, the upholstery often does not appear to be snug and tight-fitting. This problem becomes worse over time, as the upholstery loses its resiliency and thereby becomes baggy and wrinkled.

Several methods have been implemented to assist in the removal and replacement of upholstery. However, these other methods suffer from several drawbacks. One such method is to attach strips of the upholstery from opposite sides of the article of furniture. This method, however, often produces undesirable "waves" in the upholstery. Furthermore, the location where the strips attach is often inaccessible without disassembling the entire article of furniture. Another method is to form projections onto the article of furniture and clamping the upholstery onto the projections. However, not only are the clamps hard to access, but they detract from the overall appearance of the furniture.

Therefore, what is needed is a system and method that facilitates relatively simple removal and replacement of the upholstery from the article of furniture.

Furthermore, what is needed is a system and method for tightly securing and maintaining the upholstery to the article of furniture without hindering the appearance of the furniture.

SUMMARY OF THE INVENTION

The present invention, accordingly, provides a system and method for attaching upholstery to an article of furniture. The article of furniture includes a shell, such as a seat shell or a back shell having an inner and outer surface. A molded lip extends longitudinally around the outer perimeter of the shell and a tongue extends perpendicularly from the inner surface of the shell, just inside the molded lip. A first fastener strip, such as a hook fastener, is applied to the tongue so that it is facing the outer perimeter of the shell. A second fastener strip, such as a loop fastener, is attached inside the hem of the upholstery. As a result, the first and second fastener strips can engage, thereby attaching the upholstery to the article of furniture. In addition, a cushion may be secured between the shell and the upholstery when the first and second fastener strips are engaged.

An advantage achieved with the present invention is that it facilitates relatively simple removal and replacement of the upholstery from the article of furniture.

Another advantage achieved with the present invention is that it tightly secures and maintains the upholstery to the article of furniture.

DETAILED DESCRIPTION OF THE PREFERRED EMBODIMENT

Figure 1:
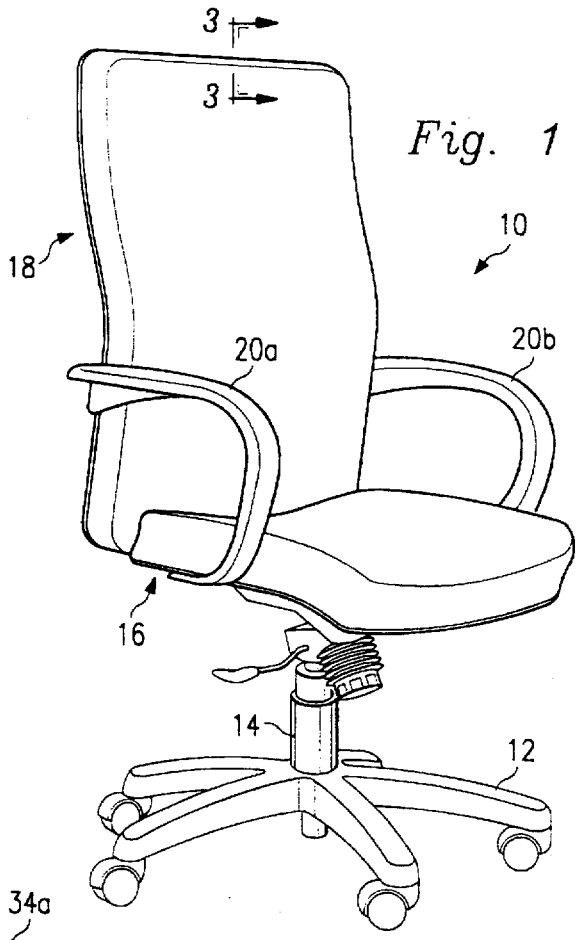
FIG. 1 is a side view of a chair embodying features of the present invention.

Referring to FIG. 1, the reference numeral 10 designates, in general, a chair. The chair 10 is an office-type chair having several legs 12, a support stem 14, a seat section 16, a back section 18 and two arm supports 20*a*, 20*b*. The legs 12, and support stem 14 are each made of steel to provide the necessary strength and support. The arm supports 20*a*, 20*b* are made of injection-molded plastic.

Figure 2:
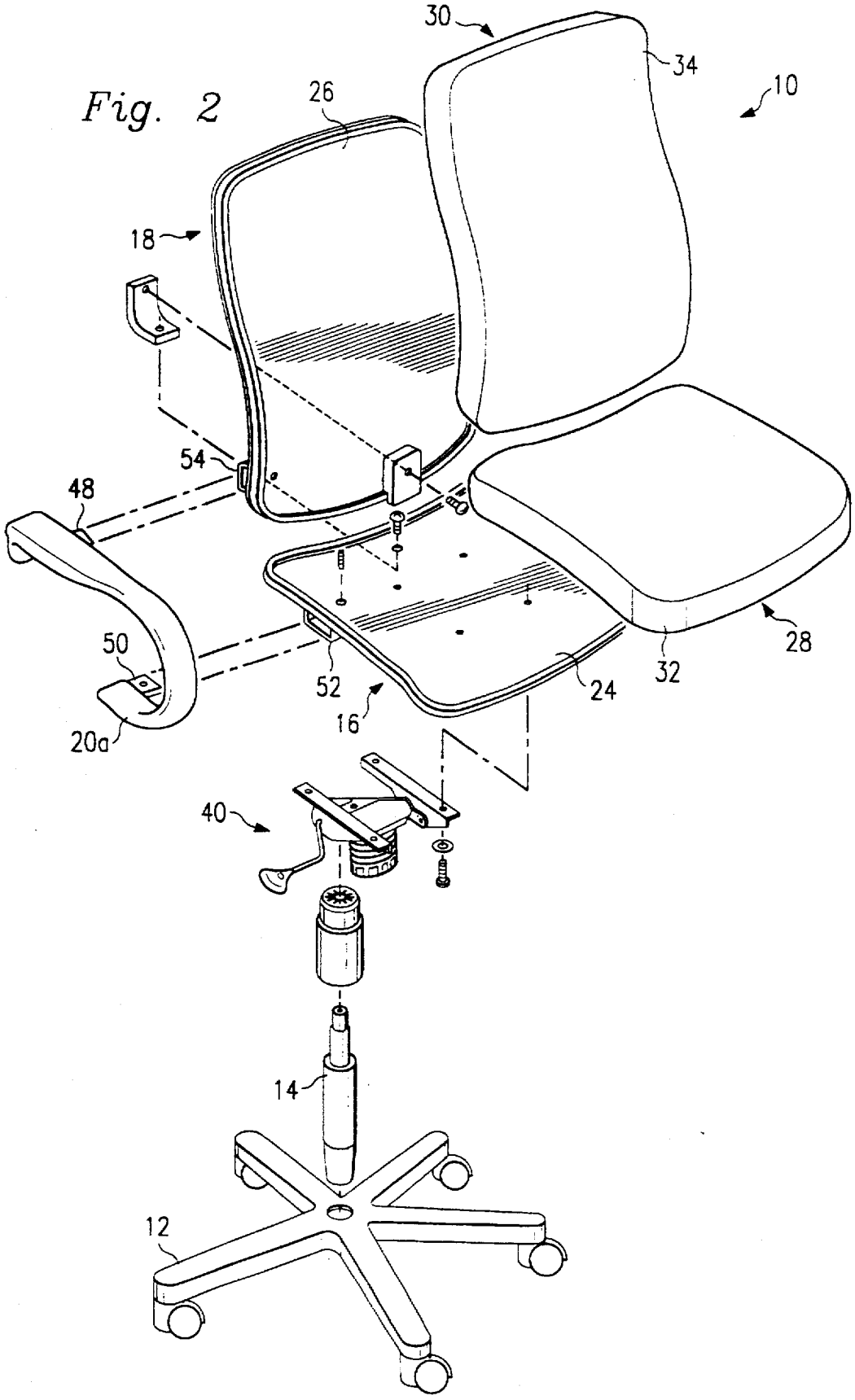
FIG. 2 is a side view of the chair of FIG. 1 with the back shell and seat shell of the chair exposed.

Referring to FIG. 2, the seat section 16 and the back section 18 each comprise a shell 24, 26, respectively, a cushion 28, 30, respectively, and an upholstery 32, 34, respectively. The seat shell 24 mounts to the support stem 14 through a positionable connector 40. The positionable connector 40 allows the seat shell 24 to rotate to different positions and orientations.

The seat shell 24 also connects to the back shell 26 at three different points. For one, an elbow plate 42 is screwed onto the shells 24, 26. The seat shell 24 also connects to the back shell 26 through the arms 20*a*, 20*b*. Each arm has one upper and one lower plate, such as the upper plate 48 and the lower plate 50 for the arm 20*a*. The seat shell 24 has two seat slots, such as the seat slot 52, and the back shell has two back slots, such as the back slot 54. The arm 20*a* is positioned so that the lower plate 50 slides into and engages with the seat slot 52 and the upper plate 48 slides into and engages with the back slot 54. Once all the plates are engaged into their corresponding slots, the overall structure of the chair 10 is more rigid and durable than any of the individual components alone.

Both the seat section 16 and back section 18 have similar arrangements for attaching the upholstery 32, 34 and the cushions 28, 30, respectively. Therefore, the following description will describe only the back section 18. It is understood, however, that the following description applies equally to the seat section 16.

Figure 3:
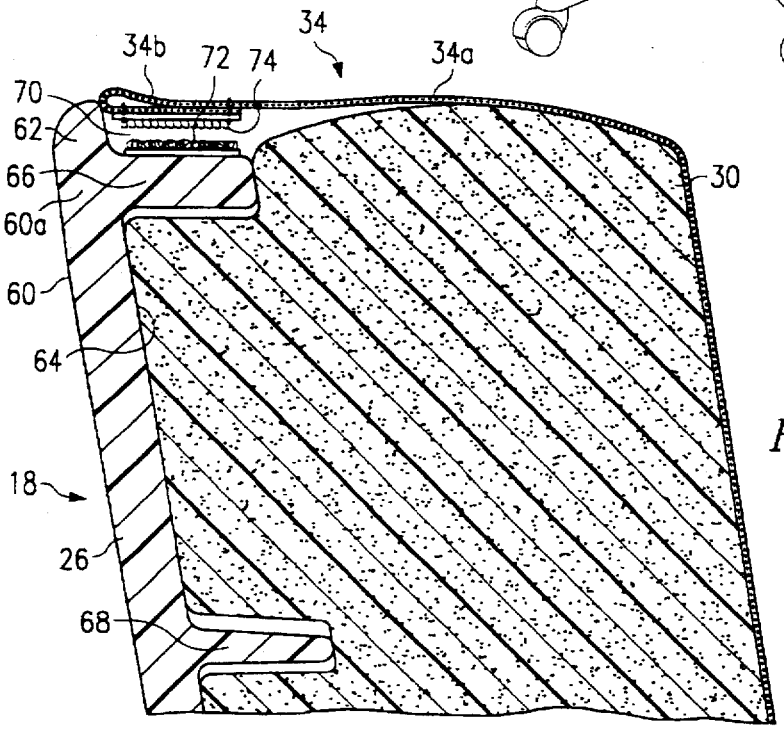
FIG. 3 is a close-up, cross-sectional view of the back shell, back cushion, back upholstery and hook and loop fastener of the chair of FIG. 1.

Referring to FIG. 3, the back section 18 includes the back shell 26, the cushion 30 and the upholstery 34. The back shell 26 is made of injection-molded plastic. The back shell 26 has a main section 60 that is relatively large and strong for supporting a user's back. The main section 60 is also basically smooth, the only noticeable screw holes or projections being those used to attach the back shell 26 to the seat shell 24 (FIG. 2). The back shell 26 also has a rounded lip 62 that extends longitudinally around a perimeter 60*a* of the main section 60. Projecting from an inner surface 64 of the main section 60 are two tongues 66, 68. The first tongue 66 extends laterally from and around the perimeter 60*a*, just inside the rounded lip 62. The first tongue 66 and rounded lip 62 form a recess area 70.

Next to the back shell 26 is the cushion 30, which is made of foam. The cushion 30 is contoured to snugly fit around both tongues 66, 68, thereby preventing any longitudinal movement of the cushion once secured. Surrounding the cushion 30 is the upholstery 34, which can be made of many different materials such as leather or polyester. The upholstery 34 includes a body portion 34*a* for covering the cushion 30 and a hem 34*b* around its perimeter for securing the upholstery to the back shell 26.

A hook fastener strip 72, with a pressure sensitive adhesive backing, is bonded to the first tongue 66 so that the "hooks" face the recess area 70. The hook fastener strip 72 extends around the entire perimeter 60*a* of the back shell 26. A loop fastener strip 74 is sewn into the hem 34*b* of the upholstery so that the "loops" also face the recess area 70. The loop fastener strip 74 extends around the entire hem of the back shell 26. When the hook and loop fastener strips 72, 74 are engaged, the upholstery 34 is secured to the back shell 26, which also secures the cushion 30.

The molded lip 62 provides several benefits. For one, the molded lip 62 serves as a guide when applying the hook fastener strip 72 to the first tongue 66. As a result, the hook fastener strip 72 can be aligned in a consistent manner. Another benefit is that the molded lip 62 serves to visually conceal the hook and loop fastener strips 72, 74. As a result, the molded lip 62 provides an appealing visual transition between the upholstery 34 and the rest of the back shell 26. Yet another benefit is that the molded lip 62 covers and protects the hook and loop fastener strips 72, 74. In this way, the molded lip 62 prevents the hook and loop fastener strips 72, 74 from collecting dust and lint and also protects a user from accidentally snagging the hem 34*b* of the upholstery 34. Still another benefit is that the molded lip 62 provides a consistent edge with which the upholstery 34 can be aligned during engagement.

Although illustrative embodiments of the invention have been shown and described, a wide range of modification, change, and substitution is contemplated in the foregoing disclosure and in some instances, some features of the present invention may be employed without a corresponding use of the other features. For example, the invention may be used with different items or different articles of furniture. Accordingly, it is appropriate that the appended claims be construed broadly and in a manner consistent with the scope of the invention.

What is claimed is:

1. An article of furniture comprising a shell including:

a main section having an inner and outer surface;

a molded lip extending longitudinally from the perimeter of the main section;

a tongue spaced from the molded lip extends outwardly and laterally from the inner surface of the main section along the perimeter; and a first fastener strip attached to the tongue;

wherein the first fastener strip may selectively engage with a second fastener strip attached to an upholstery to secure the upholstery to the shell, and wherein the molded lip hides the first and second fastener strips when engaged.

2. The article of claim 1 further comprising a cushion that is secured between the main section of the shell and the upholstery when the first and second fastener strips are engaged.

3. The article of claim 1 wherein the first and second fastener strips provide a hook and loop fastener system.

4. A method for securing an upholstery having a first fastener strip attached to a portion of its perimeter to a furniture shell having a molded lip extending longitudinally from the shell's perimeter and a tongue spaced from the molded lip extends outwardly and laterally from the shell's perimeter, the tongue having a second fastener strip attached thereto, the method comprising:

aligning the first fastener strip against the molded lip; and engaging the first fastener strip with the second fastener strip thereby hiding the first and second fastener strips.

5. The method of claim 4 further comprising securing a cushion between the shell and the upholstery when the first and second fastener strips are engaged.

6. The method of claim 4 further comprises using a hook and loop system for the first and second fastener strips.

* * * * *